United States Patent [19]

Marks

[11] 4,344,488

[45] Aug. 17, 1982

[54] CHARGED AEROSOL PETROLEUM RECOVERY METHOD AND APPARATUS

[76] Inventor: Alvin M. Marks, 153-16 10th Ave., Whitestone, N.Y. 11357

[21] Appl. No.: 178,916

[22] Filed: Aug. 18, 1980

[51] Int. Cl.[3] ..... E21B 43/24; E21B 43/243

[52] U.S. Cl. ..... 166/303; 166/65 R; 166/251; 166/261

[58] Field of Search ..... 166/59, 65, 261, 251, 166/256, 303, 302, 60, 65 R

[56] References Cited

U.S. PATENT DOCUMENTS

| | | | |
|---|---|---|---|
| 3,482,630 | 12/1969 | Earlougher, Jr. | 166/261 X |
| 3,593,789 | 7/1971 | Prats | 166/261 X |
| 3,905,553 | 9/1975 | Bradley et al. | 166/261 X |
| 4,237,973 | 12/1980 | Todd | 166/59 |
| 4,243,098 | 1/1981 | Meeks | 166/59 |

*Primary Examiner*—Stephen J. Novosad

*Attorney, Agent, or Firm*—Anthony H. Handal; Michael M. Meller

[57] ABSTRACT

A system and a method for the tertiary removal of oil from a well by introducing a fine water mist, subjecting it to an electric field to form a charged aerosol and changing the aerosol into steam to drive oil from the formation.

7 Claims, 5 Drawing Figures

CHARGED AEROSOL PETROLEUM RECOVERY METHOD AND APPARATUS

TECHNICAL FIELD

The invention relates to a method and apparatus for introducing steam under pressure into so-called "spent" oil-bearing formations to remove petroleum therefrom.

BACKGROUND ART

Petroleum recovery techniques generally divide into three categories, namely, primary, secondary, and tertiary recovery. Primary recovery merely involves drilling to the oil-bearing formation and recovering the petroleum using the natural pressure of the well to force the petroleum through a hollow pipe to the ground. Secondary recovery techniques typically involve injecting water into the well to force a mixture of petroleum and water through the well pipe to the surface.

When primary and secondary recovery techniques have ceased to remove significant amounts of petroleum, the well is defined as a "spent" well. Nevertheless, the amount of oil remaining in spent wells is, on the average, twice as large as that which has already been removed. At least some of this oil may be recovered by tertiary techniques. Thus, theoretically, we have reserves in depleted oil fields that are twice as large as the total amount of petroleum mined in this country since the industry began about a century ago. While, until recently, the employment of tertiary recovery techniques has not been economically feasible, rising world prices for the commodity has spurred the development of this sector of oil recovery technology.

Most tertiary oil recovery techniques fall into three areas, namely, thermal, miscible, and chemical. Chemical flooding generally involves the use of a detergent-like chemical which is pushed through the formation to dislodge the oil from pores in the rock by reducing the interfacial tension between water and oil and drive it to collection points from which it can be recovered. Miscible systems generally involve pumping a solvent into the formation where it mixes with the oil, forming an oil/solvent solution. This solution, because of its lower viscosity, may be pumped to the surface. In all of these cases, the mixture of oil and other substances is separated, and the oil recovered. However, neither of these systems has seen widespread use in view of the relatively large costs associated with the chemicals and processing involved.

Generally, thermal recovery techniques involve the generation of steam at the surface, and pumping of that steam and compressed air through the well pipe to the oil reservoir. The heat from the steam has the effect of decreasing the viscosity of the heavy crude in the formation. The steam under pressure then travels into the formation exerting pressure on the oil, as well as, to some extent, heating it. Ultimately, this oil is driven into perforations in the lower portion of the well pipe, thus passing into the well pipe and being drawn to the surface.

However, steam systems suffer from a number of problems. Specifically, the amount of oil consumed to generate the steam comprises a substantial portion of the oil recovered through the use of the technique. The effectiveness of the technique is hampered by the cooling and condensation of the steam on its way down to the bottom of the well. Inefficiency of the system is compounded by the loss of a substantial proportion of heat through the outer walls of the well pipe as the steam travels down to the oil-bearing formation with attendant decreases in temperature and pressure. Nevertheless, thermal recovery techniques appear to be the best hope for obtaining oil from "spent" formations.

DISCLOSURE OF INVENTION

The invention, as claimed, is intended to provide a remedy for the above-discussed problems of the prior art. It solves the problem of introducing steam into an oil-bearing formation with maximum efficiency and minimum loss of thermal energy. This is accomplished by sending only water, compressed air and electricity to the formation, dividing the water into a stable droplet cloud and generating steam from the droplets at the bottom of the well bore.

The invention thus offers several advantages. The steam is produced in-situ without the need for an external steam source. There is substantially no loss of thermal energy, as is encountered in systems injecting steam from the ground to the formation. Because water is sent to the formation and the steam is generated at the formation, there is no need to apply pressure to bring the steam into the formation. Instead, the force of gravity provides a substantial pressure at the bottom of the well because of the weight of the water column feeding the steam generator. The generation of steam and the attendant increase in volume of the water passing from the liquid to the vapor state, produces great pressure within the formation during this change of state.

BRIEF DESCRIPTION OF DRAWINGS

One way of carrying out the invention is described in detail below with reference to the drawings which illustrate only one specific embodiment, in which.

BEST MODE FOR CARRYING OUT THE INVENTION

Figure 1:
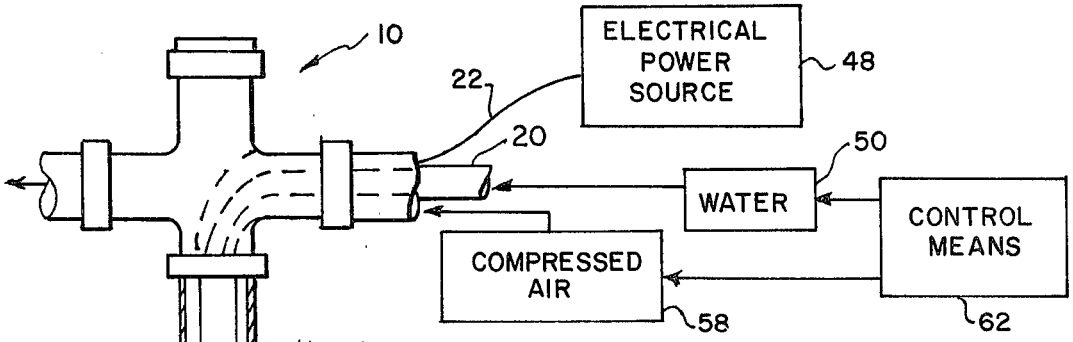
FIG. 1 is a schematic view of an oil recovery apparatus particularly useful for implementing the method of the present invention.
Figure 2:
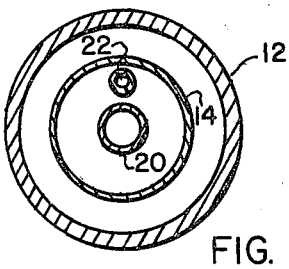
FIG. 2 is a view along lines 2—2 of FIG. 1.

Referring to FIGS. 1 and 2 a system 10 for practicing the method of the present invention in an oil recovery system is illustrated. Generally, the system comprises an outer well casing 12 and an inner pipe 14. The lower portion 16 of casing 12 is perforated allowing oil to enter the annular chamber defined between the inner pipe and the outer casing as indicated generally by arrows 18. Inner pipe 14 houses a water supply conduit 20 and an electrical cable 22. At the bottom of inner pipe 14 a droplet generator 24 is secured. Generator 24 defines a plurality of holes 26, through which droplets are emitted.

In accordance with the preferred embodiment, droplets are generated through the use of a plurality of charged aerosol generators. Such a generator is disclosed in U.S. Pat. No. 3,191,077, issued June 22, 1965 to Marks et al, entitled *Power Conversion Device.*

Figure 4:
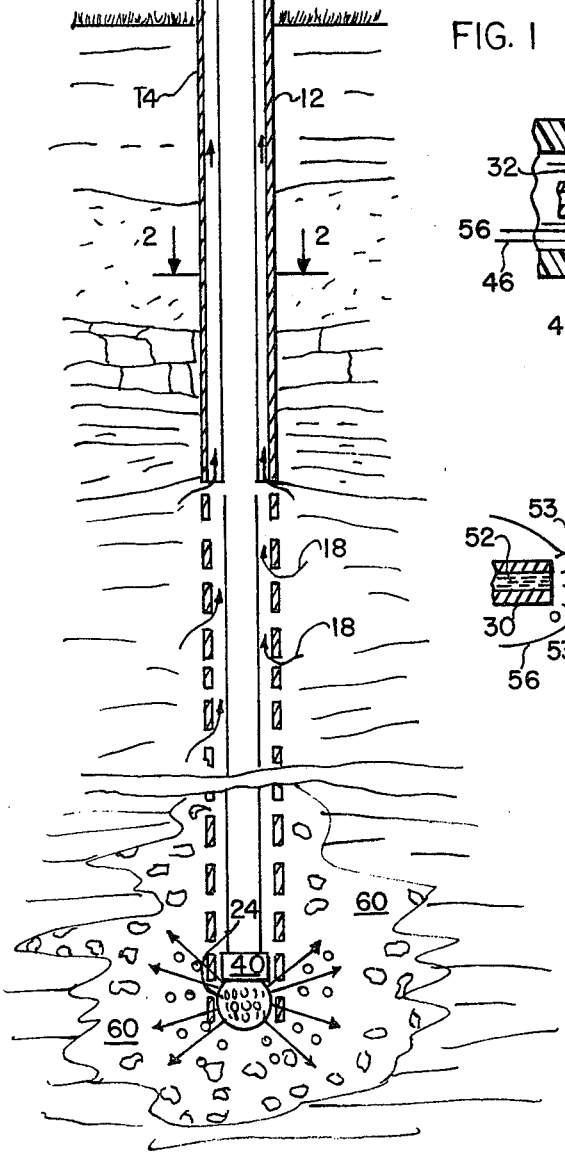
FIG. 4 is a detail of portion of the apparatus shown in FIG. 3.
Figure 4:
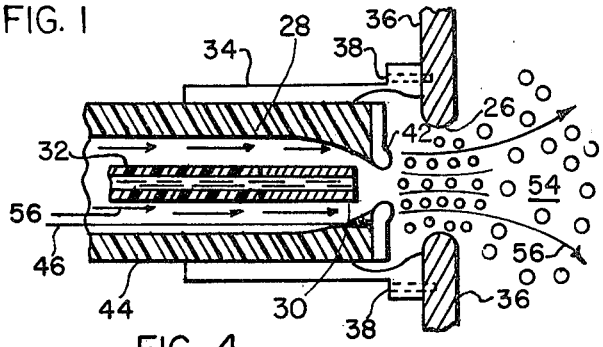
Figure 5:
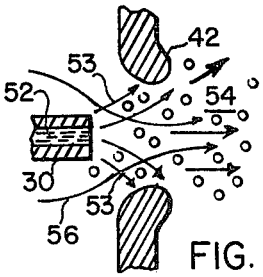
FIG. 5 is an enlarged detail view of a portion of the inventive device illustrating the droplet generator.
Figure 3:
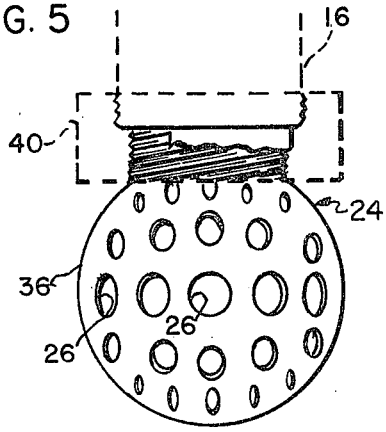
FIG. 3 is a detailed diagrammatic representation partially in cross-section of part of the apparatus illustrated in FIG. 1.

Referring to FIGS. 3, 4, and 5, each of the holes 26 is associated with a charged aerosol generator 28 which acts as a droplet source. Each charged aerosol generator 28 comprises an emitter nozzle 30 having a capillary passage and is made of a conductive material, such as stainless steel. Nozzle 30 is mounted on an electrically insulated section of tubing 32. Conduit 20 communicates with section 32 which in turn communicates with nozzle 30. The apparatus is housed within a housing 34 which may be made of stainless steel or any other suitable material. Housing 34 is in turn secured to emitter sphere 36 of generator 24 by bolts 38. Emitter 36, as illustrated in FIG. 3, is a sphere or other suitable shape made of stainless steel or other suitable material and provided with spaced apertures or holes 26. Member 40 supports the emitter 36 and attaches it to pipes 12, to water, air and electrical conduits 20, 14 and 22 respectively.

A charging or exciter ring 42 is supported on the insulating emitter support body 44. Exciter ring 42 is of any suitable conductive material, such as stainless steel. Cable 22 supplies electricity to exciter ring 42 and conductive nozzle 30 which is grounded. Cable 22 comprises a center-conductor and a coaxial shield. The cable 22 is electrically connected to the exciter ring 42 via a conductive wire 46. The return circuit is through the grounded pipe casing 12 which together with the shield is connected to nozzle 30. Compressed air is coupled to the space between the water jet nozzle 30 and the exciter ring 42. Water is coupled to nozzle 30. It will be understood that while only one droplet source is shown in FIG. 4, the apparatus includes a plurality of such sources, at least one of said sources being associated with one of each of the apertures 26 in the emitter sphere 36.

When it is desired to operate the system 10 in accordance with the method of present invention, a source of voltage 48 is coupled to cable 22. Voltage source 48 supplies a voltage of about 8,000 volts. Compressed air is then supplied to the annular chamber defined between inner pipe 14 and water supply conduit 20. Water is provided to the system by coupling a source of water 50 to water supply conduit 20. Since the outer casing 12 extends to a great depth under the ground (a length of 5,000 feet is not unusual), the water 52 supplied to nozzle 42 is under great pressure and, upon exit from the capillary passage of nozzle 30 is emitted into the region of an intense electric field, in a spray of electrically charged water droplets of very small diameter, about 0.01 to 1 $\mu$m. The charging occurs by induction. The droplet diameter and charge depends on orifice diameter, water pressure, air velocity, temperature, and electric field intensity. These variables control droplet concentration (droplets/$m^3$), droplet diameter, and charge per droplet, the velocity of the charged aerosol and the mass flow rate of water to the combustion site.

Exciter ring 42 forms a positive or negative electrode on an insulating support. The application of voltage to cable 22 applies a potential difference between nozzle 30 and exciter ring 42, which results in an intense electric field 53 between the exciter ring and the nozzle. Relative to the ring, the nozzle acts as a negative electrode, and is preferably at ground potential. The effect of the electric field is to cause the water jet emitted from nozzle 30 to explode into a cloud 54 of sub-microscopic charged liquid droplets known as a charged aerosol. The cloud is propelled from emitter 36 by the flow 56 of air from compressed air source 58.

The charged droplets in cloud 54 repel each other, thus forming a relatively stable cloud which is carried by the compressed air through the exciter ring and out of the sphere 36 from which they exit through apertures 26. The charged water droplets are then driven by the compressed air into the loose rock, crevices, cracks and debris 60 into the petroleum-bearing formation adjacent the bottom of the well casing 12. The oil in the formation is ignited in a conventional manner, as for example by an auxiliary burning jet temporarily employed to start the process (not shown herein). Combustion may be increased by increasing the amount of compressed air supplied by air source 58 to increase combustion, or decreasing the amount of water supplied by water source 50. Sources 50 and 58 are controlled by control means 62. Control means 62 may be made responsive to persons or other control means monitoring instrument sensors sensing such things as air flow, water flow, etc. or even optical or sonar image scanners at the bottom of the hole whose information can be processed by a micro-computer inside or outside the generator.

The burning oil surrounding the debris 60 produces enough heat to easily vaporize the extremely fine droplets in cloud 54. This results in an increase of volume which is about 2,000 times that of the original water fed to the bottom of the well by water supply conduit 20.

The steam thus produced has two effects. Firstly, it heats the heavy oils contained in the formation and decreases their viscosity. It also applies great pressure to the oil in the porous rock surrounding the perforated portion 16 of outer casing 12. This results in driving the oil under pressure in the direction indicated by arrows 18 into the annular space defined between outer casing 12 and inner pipe 14 and forces the oil to the surface along with gas (including combustible gases) and various impurities, which are separated by treatment on the surface.

While an illustrative embodiment of the invention has been described, it is, of course, understood that various modifications will be obvious to those of ordinary skill in the art. Such modifications are within the spirit and scope of the invention which is limited and defined only by the appended claims.

I claim:

1. Apparatus for removing petroleum from a well having a well pipe which extends from an oil-bearing formation to the surface, comprising:

(a) means for delivering a liquid to the bottom of the well;

(b) means for controlling the amount of liquid delivered to the bottom of the well;

(c) means for delivering a gaseous fluid to the bottom of the well;

(d) means for controlling the amount of said gaseous fluid delivered to the bottom of the well;

(e) a charged aerosol generator for generating from said liquid fine droplets at the bottom of the well; and (f) means for generating heat at the bottom of the well to vaporize said fine droplets of liquid.

2. Apparatus as in claim 1 wherein said charged aerosol generator, comprises, a conduit communicating with said means for delivering a gaseous fluid in a gas stream at a suitable velocity, a source of gaseous fluid connected to said conduit, an air dispensing nozzle communicating with said conduit, a capillary tube communicating with said means for delivering a liquid, a dispensing end on said capillary tube, said dispensing end exhausting its output adjacent the output of said nozzle, charging means spaced from said dispensing end of said capillary tube, a source of potential for applying a concentrated electric field between said charging means and said capillary tube end in the presence of said output gas stream to simultaneously form and charge an aerosol.

3. Apparatus as in claim 1 wherein said charged aerosol generator comprises:

(a) means for expelling a quantity of liquid;

(b) conduit means for receiving said gaseous fluid under pressure and directing it to drive said expelled liquid through an electric field to convert said liquid into a charged aerosol; and (c) a housing defining a plurality of holes for receiving said charged aerosol and expelling it into the formation.

4. Apparatus as in claim 1, 2 or 3, wherein said liquid is water and said gaseous fluid is air.

5. A method for removing petroleum from a well, having a well pipe which extends from an oil-bearing formation to the surface, comprising the steps of:

(a) delivering liquid to the bottom of the well;

(b) controlling the amount of liquid delivered to the bottom of the well;

(c) delivering a gaseous fluid to the bottom of the well;

(d) controlling the amount of gaseous fluid delivered to the bottom of the well; and (e) generating charged droplets from said liquid under pressure and vaporizing them by subjecting them to heat at the bottom of said well whereby petroleum in the well is heated and driven to the surface through the well pipe.

6. A method for removing petroleum from a well, having a well pipe which extends from an oil-bearing formation to the surface comprising the steps of:

(a) delivering liquid to the bottom of the well;

(b) controlling the amount of liquid delivered to the bottom of the well;

(c) delivering gaseous fluid to the bottom of the well;

(d) controlling the amount of gaseous fluid delivered to the bottom of the well;

(e) delivering electric power to the bottom of the well;

(f) generating a charged aerosol at the bottom of the well from said liquid, said gaseous fluid, and said electric power; and (g) vaporizing said charged aerosol under pressure at the bottom of said well whereby petroleum in the well is heated and driven to the surface through the well pipe.

7. A method for removing petroleum from a well as claimed in claims 5 or 6, wherein said liquid is water; and said gaseous fluid is air.

* * * * *